US006421513B1

(12) United States Patent
Casella et al.

(10) Patent No.: US 6,421,513 B1
(45) Date of Patent: Jul. 16, 2002

(54) TORQUE ASSIST METHOD AND APPARATUS FOR REDUCING PHOTORECEPTOR BELT SLIPPAGE IN A PRINTING MACHINE

(75) Inventors: James M. Casella; Daniel W. Costanza, both of Webster; Robert M. Lofthus, Webster, all of NY (US); Mark A. Omelchenko, Lexington, KY (US); Michael J. Martin, Hamlin, NY (US); Ssujan (James) Hou, Cheshire, CT (US); Joseph M. Wing, Ontario; Michael Furst, Rochester, both of NY (US); Orlando J. Lacayo, Santa Clara, CA (US); Mark A. Adiletta, Fairport, NY (US); Michael F. Leo, Penfield, NY (US); David K. Ahl, Rochester, NY (US); Lou Bressler, Ft. Myers, FL (US); John Sirianni, Penfineld, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/725,281

(22) Filed: Nov. 29, 2000

(51) Int. Cl.[7] ..... G03G 15/00
(52) U.S. Cl. ..... 399/162; 399/165; 399/164
(58) Field of Search ..... 399/159, 162, 399/163, 164, 165, 302, 308

(56) References Cited

U.S. PATENT DOCUMENTS 6,055,396 A * 4/2000 Pang ..... 399/164

* cited by examiner

*Primary Examiner*—Sophia S. Chen
*Assistant Examiner*—Hoang Ngo
(74) *Attorney, Agent, or Firm*—Oliff & Berridge, PLC.; Eugene Palazzo

(57) ABSTRACT

A belt drive module and a corresponding method includes or employs a belt that moves along a path, at least one support roller or other structure that supports the belt as it moves along the path, a drive roller that effects movement of the belt along the path, a tension roller that applies a tension force to the belt in order to maintain engagement of the belt with the drive and/or support rollers, at least one processing station (e.g., an image processing station) disposed along the path that performs a process relative to a predetermined position of the belt, and a torque assist drive that applies a torque assist force Td at a location between the drive roller and the tension roller. Torque assist may be provided by a current limited DC motor or by a constant torque friction clutch applied to a roller, e.g., a stripper roller of an electrophotographic imaging system. Advantageously, the torque assist force Td facilitates accurate positioning of the belt (e.g., latent image registrations in a color imaging process employing multiple imaging processing stations) by reducing slippage between the drive roller and the belt that may be encountered due to belt wear, toner contamination and/or other debris.

20 Claims, 5 Drawing Sheets

TORQUE ASSIST METHOD AND APPARATUS FOR REDUCING PHOTORECEPTOR BELT SLIPPAGE IN A PRINTING MACHINE

This invention relates to a torque assist method and apparatus to improve image registration in an electrophographic imaging system, but more specifically, To an auxiliary belt drive that overcomes unwanted drags and/or system loads.

Electrophotographic printing machines employ photoreceptor members, typically in the form of a belt that is electrostatically charged to a potential so as to sensitize the surface thereof. The charged portion of the belt is exposed to a light image of an original document being reproduced. Exposure of the charged member selectively dissipates the charge thereon in the irradiated areas to record an electrostatic latent image corresponding to the informational areas contained within an original document. After the electrostatic latent image is recorded on the photoreceptor member, a developer material is brought into contact therewith to develop the latent image. The electrostatic latent image may be developed using a dry developer material comprising carrier granules having toner particles adhering triboelectrically thereto or using a liquid developer material. Toner particles are attracted to the latent image, forming a visible powder image on the surface of the photoreceptor belt. After the electrostatic latent image is developed with the toner particles, the toner powder image is transferred to a substrate, such as a sheet of paper. Thereafter, the toner image is heated to permanently fuse the image to the substrate.

In order to reproduce a color image, the printing machine includes a plurality of imaging stations each of which deposits a toner of a giver color. Each station has a charging device for charging the photoreceptor surface, an exposing device for selectively illuminating the charged portions of the photoreceptor surface to record an electrostatic latent image thereon, and a developer unit for developing the electrostatic latent image with toner particles. Each developer unit deposits different color toner particles on the electrostatic latent image. The images are developed, at least partially, in superimposed registration with one another to form a multi-color toner powder image. The resultant multicolor powder image is subsequently transferred to a substrate. The transferred multi-color image is then permanently fused to the sheet forming the color print. To obtain a high quality image, registration of the images at each of the developer stations is essential.

Registration is achieved by accurately positioning the photoreceptor belt at the various imaging and developing stations along the belt path using a drive mechanism that typically comprises drive rollers that advance a substrate along the path and backer bars that support the belt. Many such drive rollers have a coating commercially known as an EPDM elastomer that is applied to the surface thereof to improve friction coupling between the drive mechanism and the belt. Due to backer bar and subsystem drag, the drive rollers often experience slippage the photoreceptor belt and at other locations along the belt when the surface of the drive roller encounters particle contamination. Slippage has a deleterious impact on image registration, particularly when latent images are applied at multiple imaging stations.

An auxiliary belt drive may address slippage problems, but in order to be effective, the torque level and proper location of the auxiliary drive is essential to attain optimum drive benefit while at the same time satisfying motion quality and registration requirements of the imaging system. In addition, belt tensioning and drive capacity requirements must also be met.

SUMMARY OF THE INVENTION

In accordance with one embodiment of the invention, a belt drive module that achieve the above and other goals comprises a belt that moves along a path, at least one support roller that supports the belt along the path, a drive roller that effects movement of the belt along the path, a tension roller that applies a tension force on the belt in order to maintain engagement of the belt with the drive and support rollers, at least one processing station (e.g., an image processing station) disposed along the path to perform a process relative to a position of the belt, and a torque assist drive that applies a torque assist force $T_d$ at a location between the drive roller and the tension roller.

In accordance with another aspect of the invention, a method of providing a torque assist force $T_d$ to a belt in a belt drive mechanism comprises providing a roller support structure that guides movement of the belt along a predetermined path that includes processing stations, applying a drive force to rotate the belt along the path, applying a tension force to a slack side of the belt relative to the drive force in order to maintain tension during movement of the belt along the path, and providing a torque assist force $T_d$ to the belt at a location between the drive force and the tension force.

Advantages provided by the invention include reduced drive roll maintenance. With torque assist, periodic cleaning of the drive roll in the field is reduced. In addition, catastrophic failures may be avoided. For example, should a sudden change in contamination level occur during operation of the belt drive mechanism, the torque assist drive provided herein is robust against a low friction coefficients on the drive and torque assist roll surfaces thereby to prevent a catastrophic failure due to, for example, contamination or other debris.

Other features of the invention include providing a constant torque friction clutch or a current limited DC motor to provide the torque assist force. The invention, though, is pointed out with particularity by the appended claims.

DESCRIPTION OF ILLUSTRATIVE EMBODIMENTS

Figure 1:
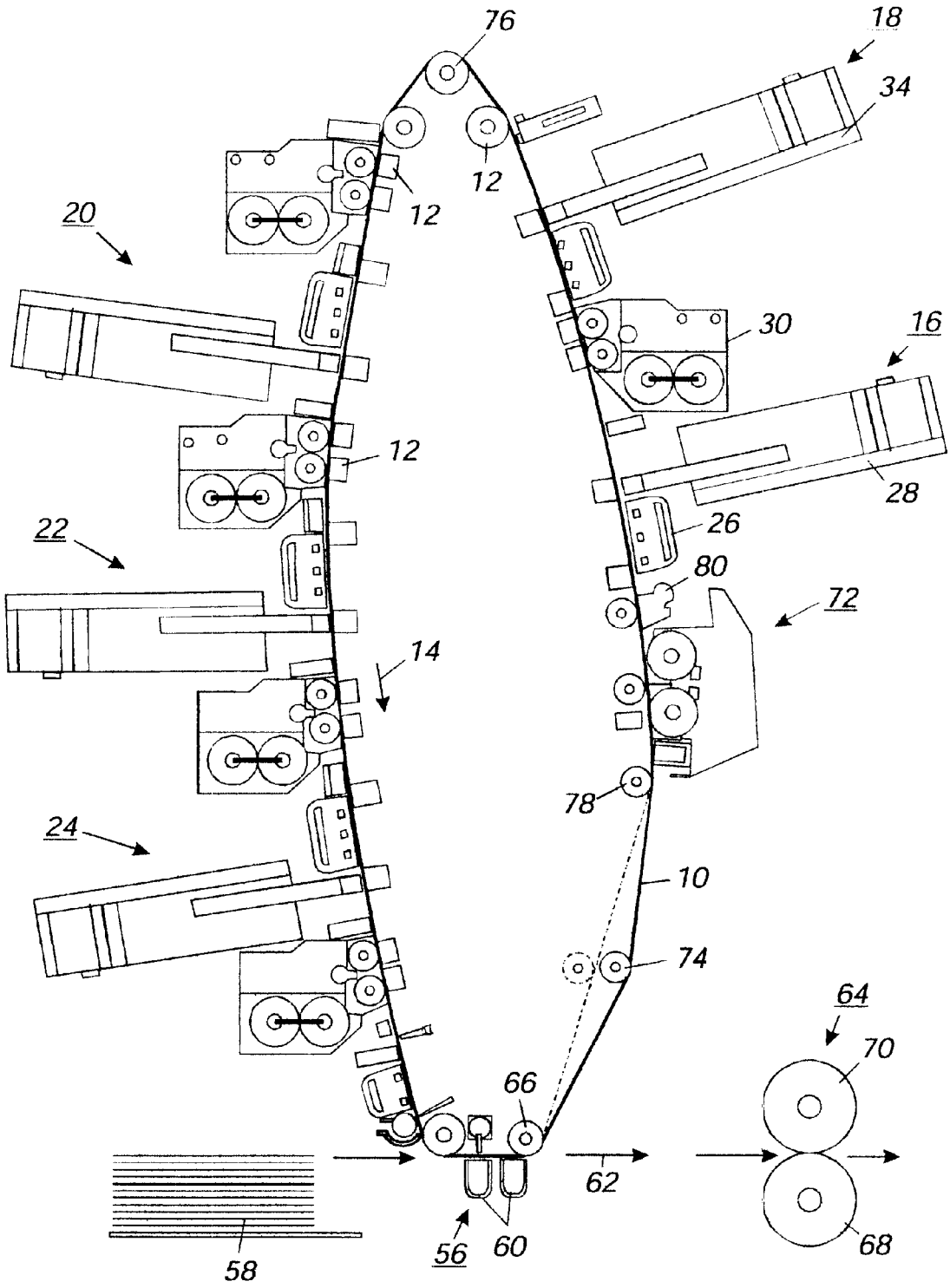
FIG. 1 shows a belt drive module of an electrophotographic imaging system to illustrate an environment in which the present invention may be deployed.

For a general understanding of the features of the present invention, reference is made to the drawings in which like reference numerals have been used throughout to designate similar elements.

Referring now to the drawings, there is shown a single pass multi-color printing machine. This printing machine employs a photoreceptor belt 10, supported by a plurality of rollers or backer bars 12. Belt 10 advances in the direction of arrow 14 to move successive portions of the external surface of photoreceptor belt 10 sequentially along a path including various image processing stations.

The illustrative printing machine includes five image recording stations indicated generally by the reference numerals 16, 18, 20, 22, and 24, respectively. Initially, belt 10 passes through image recording station 16. Image recording station 16 includes a charging device and an exposure device. The charging device includes including a corona generator 26 that charges the exterior surface of belt 10 to a relatively high, substantially uniform potential. After charging of the exterior surface of photoreceptor belt 10, the charged portion thereof advances to an exposure device. The exposure device includes a raster output scanner (ROS) 28, which illuminates the charged portion of the exterior surface of photoreceptor belt 10 to record a first electrostatic latent image thereon.

Developer unit 30 develops this first electrostatic latent image. Developer unit 30 deposits toner particles of a selected color on the first electrostatic latent image. After the highlight toner image has been developed on the exterior surface of belt 10, belt 10 continues to advance in the direction of arrow 14 to a second image recording station 18 where the imaging process is repeated at recording stations 18, 20, 22, and 24, as described in incorporated U.S. Pat. No. 5,946,533, assigned to the same assignee hereof. Recording stations 18, 20, 22, 24 include components similar to recording station 16, but are arranged to deposit a different color toner.

At each recording station, a latent image recorded in registration with the previous latent image. Photoreceptor belt 10 ultimately advances the multi-color toner powder image to a transfer station, indicated generally by the reference numeral 56. At transfer station 56, a receiving medium, i.e., paper, is advanced from stack 58 by a sheet feeder and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoreceptor belt 10. A vacuum transport moves the sheet of paper in the direction of arrow 62 to fusing station 64.

Fusing station 64 includes a heated fuser roller 70 and a backup roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets, which may be bound to one another. These sets are then advanced to a catch tray for subsequent removal therefrom by the printing machine operator.

Invariably, after the multi-color toner powder image has been transferred to the sheet of paper, residual toner particles remain adhering to the exterior surface of photoreceptor belt 10. The photoreceptor belt 10 moves over isolation roller 78, which isolates the cleaning operation at cleaning station 72. At cleaning station 72, the residual toner particles are removed from belt 10. The belt 10 then moves under spots blade 80 to also remove toner particles therefrom.

It has been determined that belt tensioning member 74, preferably a roller that is resiliently urged into contact with the interior surface of photoconductive belt 10, has a large impact on image registration. Heretofore, tensioning of the photoconductive belt was achieved by a roller located in the position of steering roll 76. In printing machines of this type, the image recording stations were positioned on one side of the major axis with preferably there being one image recording device on the other side thereof.

Figure 2:
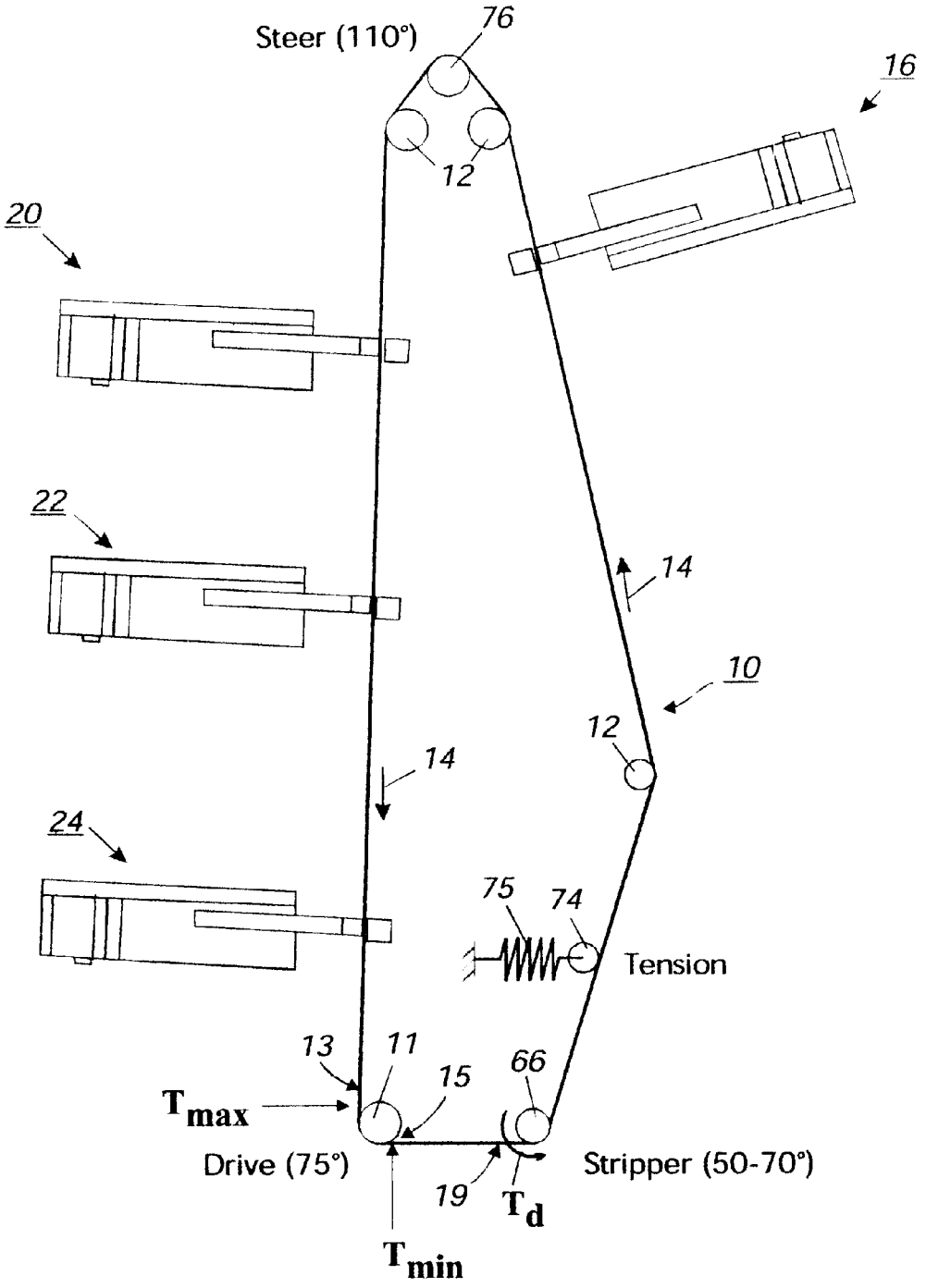
FIG. 2 conceptually illustrates a drive belt and a preferred location of a torque assist force in accordance with principles of the present invention.

Observation of drive belt behavior during slippage and testing under these conditions, in part, led to development of various embodiments of the invention illustrated herein. FIG. 2 symbolically illustrates a belt drive module of an electrophotographic imaging system similar to that depicted in FIG. 1 that includes a photoreceptor ("PR") drive belt 10, a drive roller 11, a steering roller 76, a support roller 12, stripper roller 66, a tension roller 74 with spring 75, and in accordance with the present invention, a torque assist force $T_d$ applied between the drive roller 11 and tension roller 74. Drive roller 11 provides a primary driving force Tmax for drive belt 10 as it moves latent images on the belt through the image processing stations 16, 20, 22, and 24 of the belt drive module. In many imaging systems, drive roller 11 includes an EPDM coating to improve friction coupling between belt 10 and drive roller 11. Imaging stations 16, 20, 22, and 22 disposed along the path of belt 10 deposit and develop latent images from chemical or other toners in an amount and intensity according to color separations of an original image. In operation, a first latent image is formed on belt 10 at imaging station 16, and then that latent image is passed, desirably in complete registration formed with other latent images at imaging stations 20, 22, and 24 by action placed on belt 10 by drive roller 11. To obtain registration of color separations of an original image at the various imaging stations 16, 20, 22, and 24, it is important that no slippage occurs between the belt 10 and drive roller 11. This is achieved by providing, in an environment subjected to contamination, a minimum level of friction coupling between belt 10 and drive roller 11.

Testing has shown that the friction coefficient provided by drive roller 11, although starting above 1.0 when new, ultimately drops to about 0.4 due to surface contamination and surface glazing. Surface contamination was found to be mostly attributed to what is known as anti-curl back coating ("ACBC") wear on the backside of photoreceptor ("PR") belt 10, toner particle contaminates, paper dust particulates, etc. An ACBC coating typically comprises a polycarbonate plastic material that improves friction coupling of the drive roller with the backside of the photoreceptor belt, but even this can wear and cause contamination. Such contamination decreases the coefficient of friction between the drive roller 11 and the photoreceptor belt 10. This decrease in the coefficient of friction causes drive roller slippage which, for a remote encoded belt module, caused the belt 10 to stall. PR belt stall is the resulting failure mode stemming from drive roller surface contamination.

To prevent the PR belt stall, the drive capacity of belt 10 was increased in accordance with one aspect of the present invention by providing an auxiliary drive force $T_d$ on the upside of stripper roller 66. In explanation, drive capacity is defined herein as the additional (excess) drive force delivered by a belt module without slipping the drive roller 11 with respect to photoreceptor belt 10. This relationship is given in equation (1) as $$\text{Tmaxslip}=\text{Tmin}*e^{(\mu*\theta)} \qquad \text{Eq. (1)}$$

where $\mu$ and $\theta$ are the drive roller/drive belt friction coefficient and belt wrap angle, respectively, Tmin is the belt tension on the immediate slack side 15 (i.e., the acoustic transfer assist ("ATA") location) of the drive roller 11, and Tmaxslip is the tension on the tension side 13 of belt 10 at which drive roller slippage occurs between belt 10 and drive roller 11. Toner particles are transferred to the paper substrate at the ATA location. Excess drive capacity is then defined in equation (2) as $$\text{Drive Capacity} = \text{Tmaxslip} - \text{Tmax} \qquad \text{Eq. (2)}$$

where Tmax is the tension at the immediate tension side 13 of the drive roller 11. If the drive capacity value is greater than zero, there is sufficient latitude in the belt module design to drive the PR belt 10 in the presence of all subsystem and backer bar drags as well as the reduced friction coefficient of the drive roller surface.

Figure 3A:
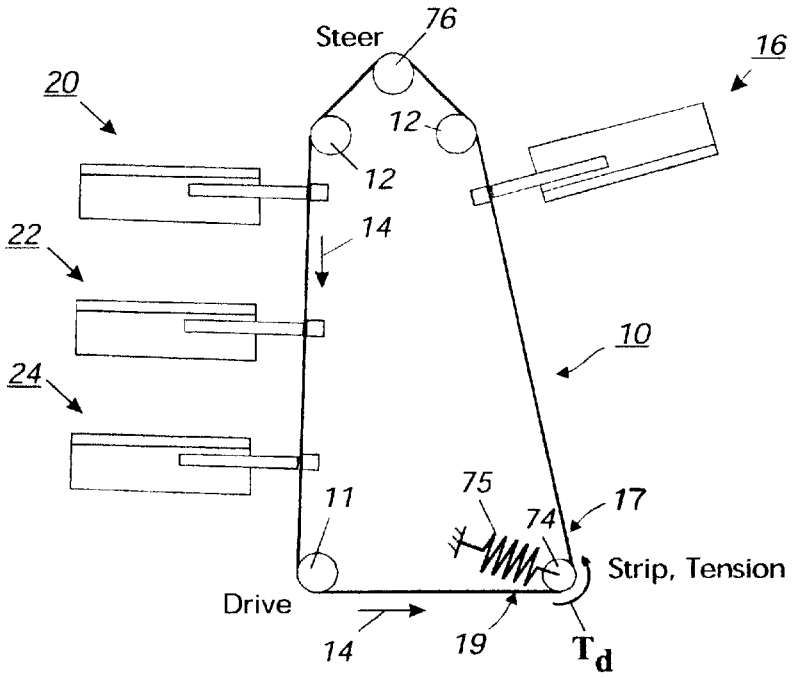
FIGS. 3A and 3B illustrate the application of torque assist forces at less than optimal locations of a belt drive module.
Figure 3B:
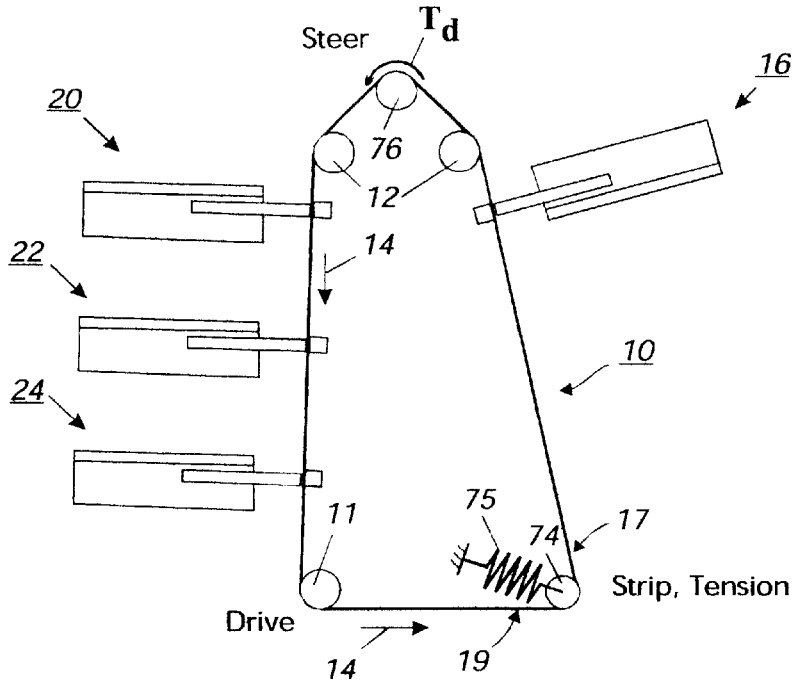

To emphasize the importance of proper location of the auxiliary torque drive force $T_d$, it was observed that modeling results of conventional belt module architectures had insufficient latitude in their designs. FIGS. 3A and 3B, for example, illustrate drive capacity for two conventional belt module designs when the drive roller friction coefficient decreases to 0.4. Results below show that a capability index in an exemplary belt drive module, in the absence of torque assist applied at stripper roller 74, was −0.55, compared to +1.54 when a 2.0 in*lb torque assist was provided, such as that provided by torque assist $T^d$ of FIG. 1.

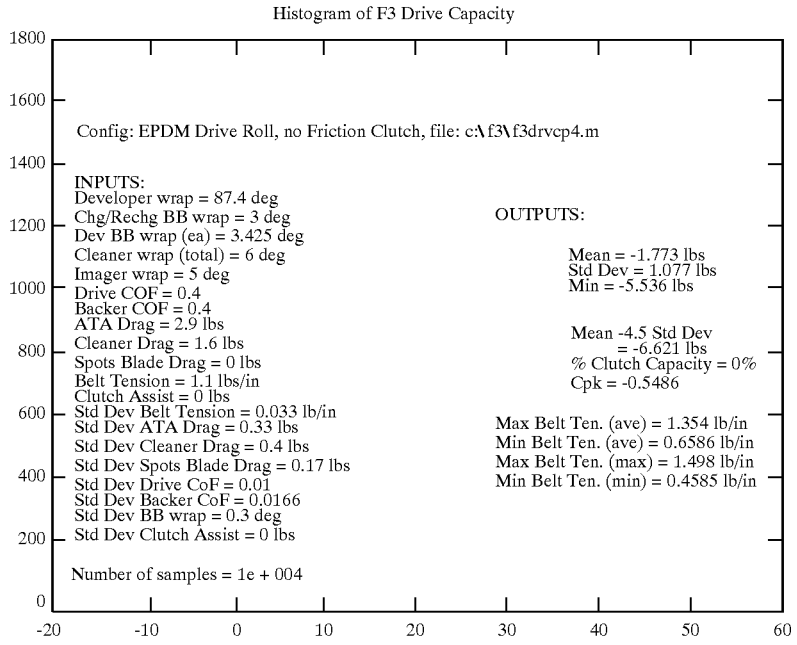

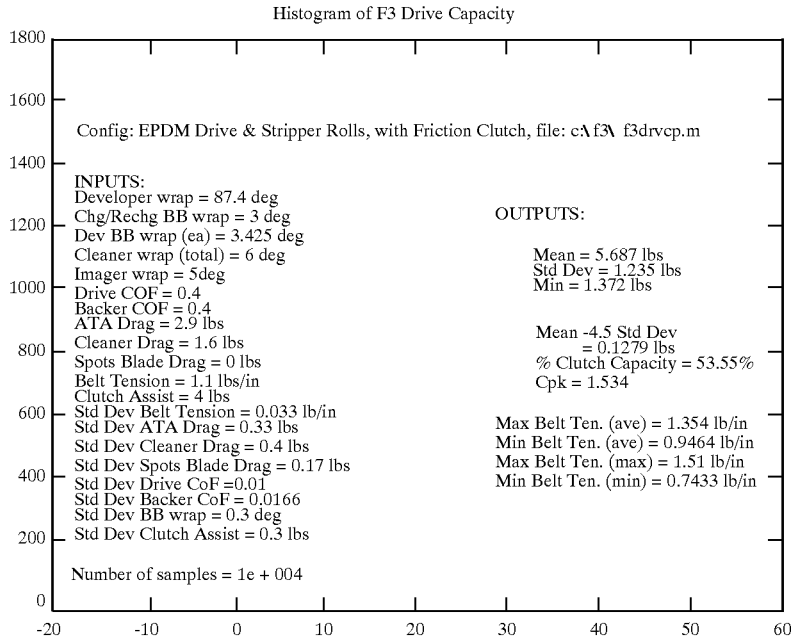

Figure 4A:
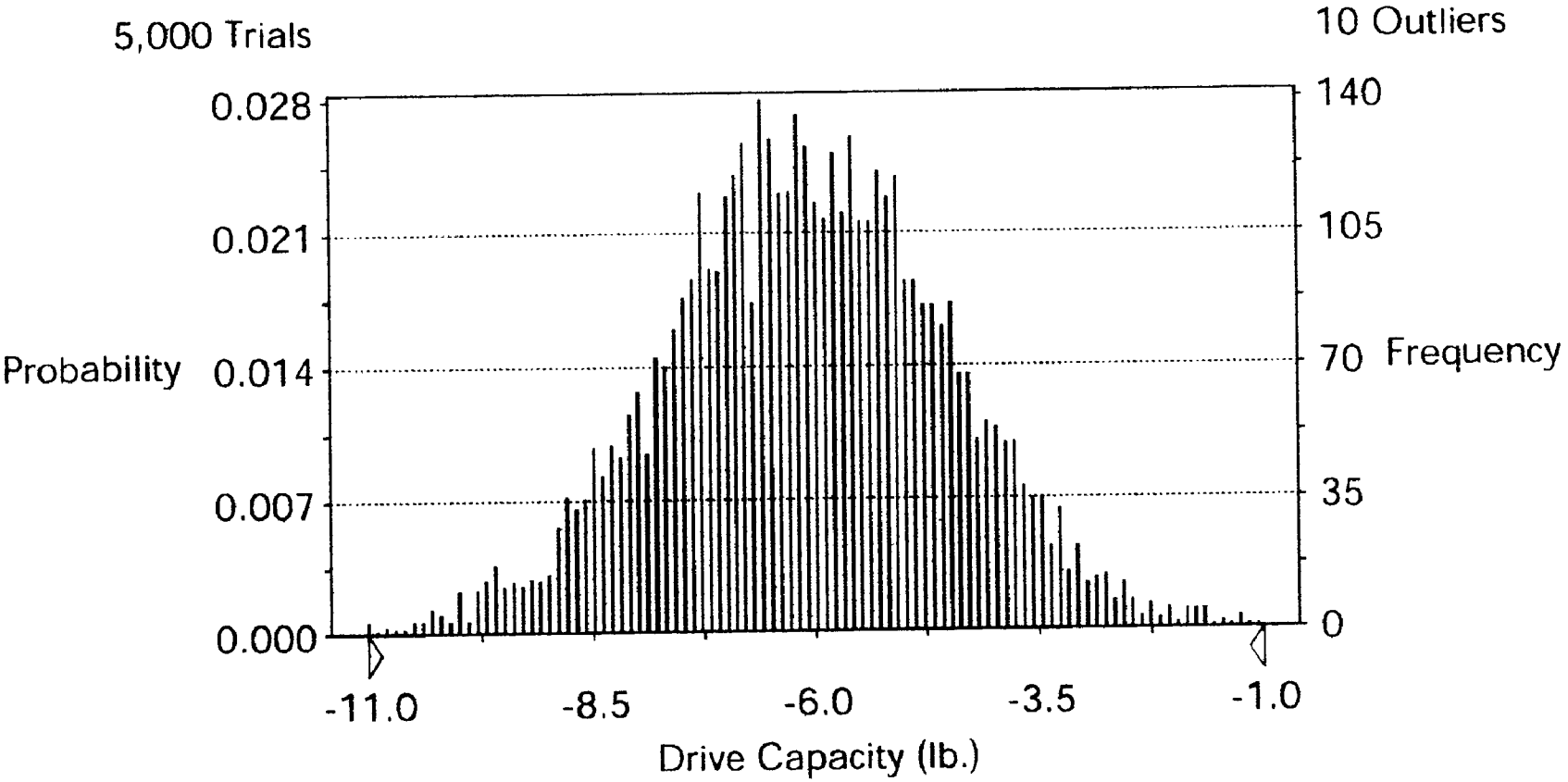
FIGS. 4A and 4B respectively illustrate the impact on drive capacity when the drive roll coefficient decreases, without and with torque assist.
Figure 4B:
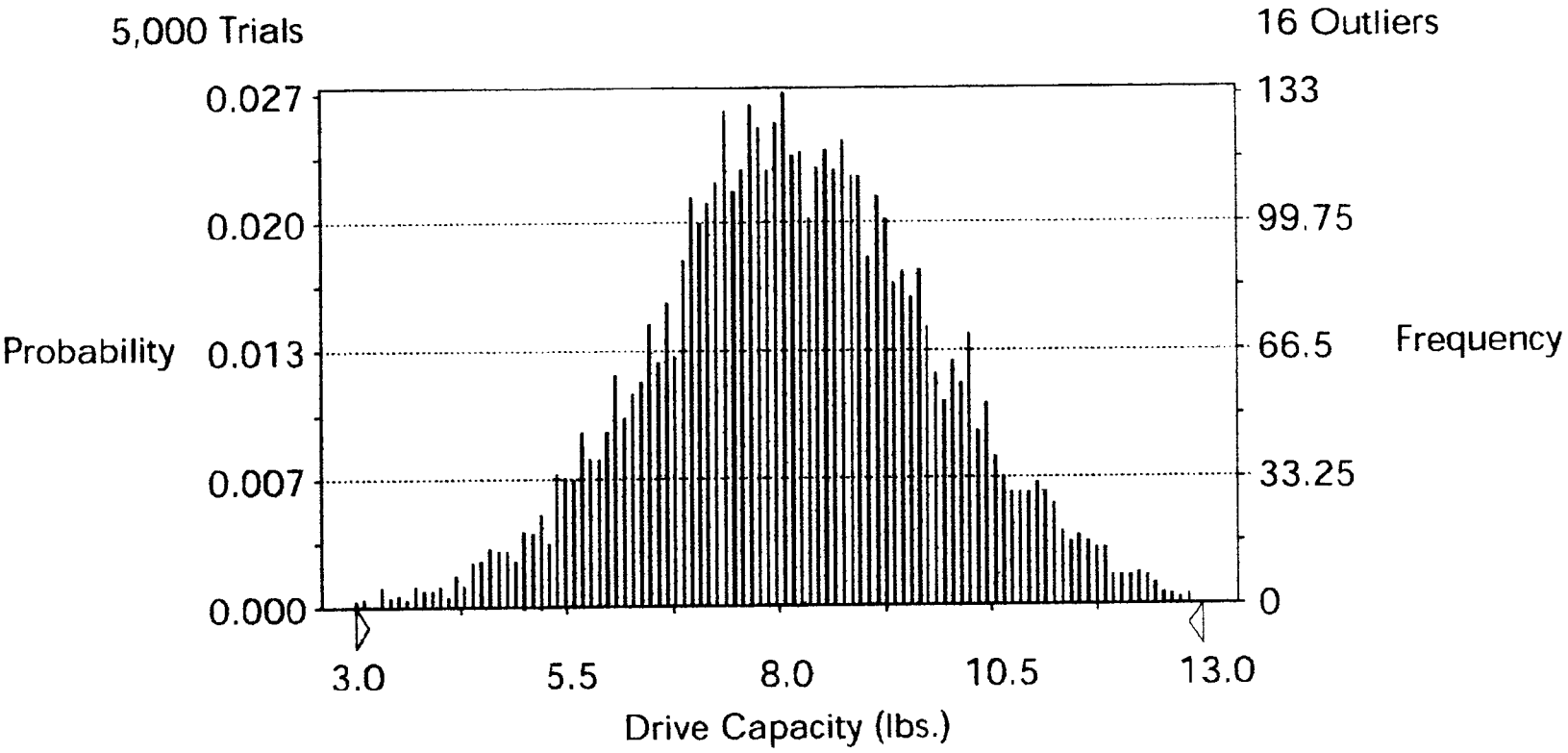

FIGS. 4A and 4B illustrate drive capacity modeling results for another exemplary belt module when the drive roller friction coefficient decreases to 0.4. Results show that the capability index when no torque assist at the stripper roller is used was −0.55, compared to +1.54 when a 2 in*lb torque assist $T_d$ was used.

Modeling results indicate that unless the drive roller friction coefficient can be maintained at 0.7 during periodic maintenance and service calls, slippage may be a continued problem for many belt module designs.

Testing was performed with a torque assist drive located at stripper roller 74, as shown in FIG. 3A, and at steering roller 76, as shown in FIG. 3B. Upon evaluation of each of these designs, it was determined that torque assist could not be located at the tension roller 74, or at any other roller upstream (tension side 17) from the tension roller 74 without sacrificing accuracy in image registration. The result is a compression of the tensioning spring 75 when switching from a standby mode to a machine run mode. The amount of compression placed on spring 75, which varies with the spring constant rate, is an order of magnitude greater than the critical compression allowed. Thus, torque assist at these locations would cause the belt path to decrease, lowering the tension in the belt. The torque assist $T_d$ must therefore be applied to a roller downstream on the slack side 19 of the tensioning roller 74, as depicted in FIG. 1.

In one implementation of a torque assist drive according to the invention, a friction clutch was attached to stripper roller 66 and driven from the main drive motor of belt 10. As known in the art, a friction clutch when spun at a rate faster than the load it engages provides a constant torque to the load, e.g., stripper roller 66. Examples of friction engagement by the friction clutch include a wrap spring, a magnetic particle clutch, and other arrangements. Results revealed no motion quality errors from the clutch or belt drive to the clutch. The only apparent impact of the clutch was a slight increase in motor ripple error. Measurements showed that the first and third harmonics of motor ripple error increased by 6% and 10%, respectively, which was found to produce images of acceptable quality.

In another implementation of the invention, an auxiliary torque assist drive $T_d$ includes a DC motor with a 12.5:1 gearbox ratio coupled to stripper roller 66 through a flexible coupling known in the art as a Rembrant coupling. A Rembrant coupling includes a mechanism for measuring precise angular position. Other gearbox ratios may also be used. A current limited control was applied to the DC motor by converting a source voltage to current using a commercially available transconductance amplifier. The DC motor then generated a constant torque, independent of load, based on the torque constant of the DC motor. Results of this test indicated that motion quality remained relatively constant though a torque assist range of 0–100%. Ripple error in the main drive motor was also reduced to 30% of its initial value when using the torque assist. Ripple errors from the torque assist motor were apparent on the surface and need to be controlled.

While the present invention is described in connection with preferred embodiments thereof, it will be understood that it is not intended to limit the invention to those embodiments. On the contrary, it is intended to cover all alternatives, modifications and equivalents as may be included within the spirit and scope of the invention as defined by the appended claims.

We claim:

1. In an electrophotographic imaging system that includes a photoreceptor belt and a drive roller that is friction-coupled to the photoreceptor belt for moving the belt to multiple image processing stations of said system, said system further including a tension roller that exerts a tension force on said belt, the improvement comprising:

a torque assist drive that applies a torque assist force $T_d$ to said drive belt at a location on a slack side of the drive roller downstream of said tension roller.

2. The improvement as recited in claim 1, further including a stripper roller between said drive roller and said tension roller, and said torque assist force $T_d$ is provided by a DC motor coupled with said stripper roller.

3. The improvement as recited in claim 2, wherein said DC motor is driven by a current limited supply.

4. The improvement as recited in claim 3, wherein said current limited supply is provided by converting a source voltage to a current source using a transconductance amplifier.

5. The improvement as recited in claim 1, wherein said torque assist force $T_d$ is supplied by a constant torque friction clutch coupled to a stripper roller of said photoreceptor belt.

6. The improvement as recited in claim 5, wherein said friction clutch is engaged during movement of said photoreceptor belt.

7. A belt drive module comprising:

a belt that moves along a path, at least one support roller that supports said belt along the path, a drive roller that effects movement of said belt along said path, a tension roller that applies a tension force to said belt thereby to maintain engagement of the belt with said drive roller and said at least one support roller, at least one processing station disposed along said path that performs a process relative to a predetermined position of the belt, and a torque assist drive that applies a torque assist force $T_d$ at a location between said drive roller and said tension roller.

8. The belt drive module as recited in claim 7, wherein said belt comprises a photoreceptor belt of an electrophotographic imaging system.

9. The belt drive module as recited in claim 8, wherein said processing station forms a latent image on said belt at respective locations along said path.

10. The belt drive module as recited in claim 9, further comprising a stripper roller disposed between the drive roller and the tension roller.

11. The belt drive module as recited in claim 10, wherein said torque assist drive comprises a DC motor that applies said torque assist force $T_d$ to said stripper roller.

12. The belt drive module as recited in claim 11, wherein said DC motor is powered by a current limited power supply.

13. The belt drive module as recited in claim 12, wherein said current limited control is provided by converting a source voltage to a current using a transconductance amplifier.

14. The belt drive module as recited in claim 10, wherein said torque assist drive $T_d$ comprises a friction clutch coupled to the stripper roller of said photoreceptor belt.

15. The belt drive module as recited in claim 14, wherein said friction clutch is engaged during movement of said photoreceptor belt.

16. A method of providing a torque assist force $T_d$ to a belt in a belt drive mechanism, said method comprising:

providing a support structure that guides movement of the belt along a predetermined path of processing stations, applying a drive force to rotate the belt along the path, applying a tension force on a slack side of the belt from the drive force in order to maintain tension during movement of the belt thereof along said path, and providing said torque assist force $T_d$ to the belt at a location between the drive force and the tension force.

17. The method as recited in claim 16, further comprising:

performing an image processing operation during positioning of the belt at multiple image processing stations disposed along the path of the belt.

18. The method as recited in claim 17, further comprising:

providing a stripper roller between the driving force and the tension force, and applying the torque assist force $T_d$ at the stripper roller.

19. The method as recited in claim 18, further comprising applying the torque assist force $T_d$ by coupling a DC motor to said stripper roller.

20. The method as recited in claim 18, further comprising applying the torque assist force $T_d$ by using a friction clutch acting on said stripper roller.

* * * * *